US005414933A

United States Patent [19]

Garner

[11] Patent Number: 5,414,933

[45] Date of Patent: May 16, 1995

[54] CUTTING DEVICE

[76] Inventor: Ted V. Garner, P.O. Box 2221, Norwalk, Conn. 06850

[21] Appl. No.: 160,038

[22] Filed: Nov. 30, 1993

[51] Int. Cl.[6] ..... B26B 29/00

[52] U.S. Cl. ..... 30/151; 30/286; 30/294; 30/315; 30/331; 30/DIG. 3

[58] Field of Search ..... 30/2, 125, 151, 164, 30/280, 286, 289, 294, 298.4, 314, 315, 329, 337, DIG. 3, 330, 331; 606/167

[56] References Cited

U.S. PATENT DOCUMENTS

| | | | |
|---|---|---|---|
| 142,942 | 9/1873 | Ratelle | 30/289 |
| 1,192,748 | 7/1916 | Bundy | 30/286 |
| 2,198,814 | 4/1940 | Hart | 30/286 |
| 2,512,237 | 6/1950 | Mravik | 30/151 |
| 2,864,165 | 12/1958 | Catallo | 30/294 |
| 2,867,901 | 1/1959 | Warnes | 30/151 |
| 2,882,598 | 4/1959 | Fidelman | 30/294 |
| 3,230,620 | 1/1966 | McKinley Embleton | 30/286 |
| 4,028,802 | 6/1977 | Houghton et al. | 30/294 |
| 4,081,907 | 4/1978 | Bosshold | 30/DIG. 3 X |
| 4,091,537 | 5/1978 | Stevenson, Jr. | 30/151 X |
| 4,393,587 | 7/1983 | Kloosterman | 30/162 |
| 4,587,735 | 5/1986 | Walters et al. | 30/286 |
| 4,757,612 | 7/1988 | Peyrot | 30/151 |
| 4,922,610 | 5/1990 | Szabo | 30/125 |
| 5,341,822 | 8/1994 | Farr et al. | 30/294 |
| 5,347,719 | 9/1994 | Scharf | 30/294 |

*Primary Examiner*—Richard K. Seidel

*Assistant Examiner*—Clark F. Dexter

*Attorney, Agent, or Firm*—John R. Doherty

[57] ABSTRACT

The present invention is directed to a letter opening device comprising an elongated tubular handle, a removable tubular cap and a generally L-shaped cutting guide including a cutting blade and a blade holder. The cutting guide is affixed to the forward end of the tubular handle and has an elongated nose portion which is adapted to fit underneath the flap of an envelope to be opened. The elongated nose portion has an elongated groove for receiving the sharp tip of the cutting blade. The blade holder is pivotally mounted to the cutting guide and can be moved to easily replace the blade. An elongated safety shield is slidably mounted inside the tubular handle for shielding the blade when the letter opening device is not in use. The shield has an actuating member attached thereto for moving the shield within the tubular handle. The actuating member extends through an elongated slot in the tubular handle and is movable along the slot to locate the shield in either a first position covering the blade or a second position uncovering the blade for use in cutting the flap of the envelope. The tubular cap also has an elongated slot which can be aligned with the slot in the handle allowing free movement of the actuating member. Conversely, the actuating member can be fixed against movement to lock the shield in its first position covering the blade when the tubular cap is orientated so that the slots are not aligned.

14 Claims, 3 Drawing Sheets

CUTTING DEVICE

BACKGROUND OF THE INVENTION

The present invention relates to cutting devices in general and more particularly to an improved letter opener employing a cutting blade and cutting guide element for cutting through the flap of a conventional envelope. In a more specific aspect, the invention relates to a letter opener of the type which employs a retractable safety shield for covering the cutting blade during periods of non-use.

Various attempts have been made to construct cutting devices of the type wherein the cutting blade is protected by a safety shield when the device is not in use. Typically, the safety shield is pivotally mounted to the cutting device or retractably held in position over the cutting blade by a coil spring or other biasing element. These proposals, however, have proven to be ineffective, difficult to operate or too costly to manufacture and market at a reasonable price.

U.S. Pat. No. 3,230,620 to Embleton, for example, discloses a cutting device employing a cutting blade for severing tape, surgical bandages and the like wherein the blade is protected by a shield or guard which is pivotally mounted to the device. The shield or guard pivots away from the blade and exposes the blade as the cutting device travels through the tape or bandage.

U.S. Pat. No. 4,028,802 to Houghton discloses a similar device for cutting loops in a carpet. The shield pivots away from the blade as the device passes through the loops. The problem with these prior art devices is that they depend on gravity to keep the shield in place over the blade and thus are ineffective when placed in other than an upright position.

U.S. Pat. No. 4,091,537 to Stevenson, Jr. discloses a safety utility knife employing a conventional cutting blade protruding from an elongated handle. The cutting blade is shielded by a retractable guard biased into position over the blade by a coil spring. The guard retracts into the handle against the force of the spring and is kept in this position by a spring-loaded trigger. Once the trigger is released, the spring forces the guard into its shielding position over the cutting blade. This utility knife is obviously cumbersome to use and employs a number of expensive parts including the spring and trigger assembly and is costly to manufacture.

Other similar cutting devices employing spring-loaded or biased shielding elements to protect the cutting blades are known in the art such as those disclosed, for example, in U.S. Pat. Nos. 142,942; 986,531; 2,512,237; 2,882,598; 4,393,587; 4,757,612 and German Pat. No. 1,264,288.

U.S. Pat. No. 2,867,901 to Warnes discloses a utility knife employing a conventional single edge blade secured within an elongated flat handle. A flat retractable shield is slidably mounted within the handle and is provided with a knurled knob to facilitate moving the shield from one position protecting the blade to another position exposing it to for use during the cutting operation. However, this knife does not employ springs or any means for positively locking the shield in place over the cutting blade.

It is therefore an important object of the invention to provide an improved cutting device which overcomes the shortcomings of the prior art.

Another object of the invention is to provide an improved cutting device and particularly a letter opener which is simple in construction, inexpensive to manufacture and yet effective and efficient to use.

A more specific object of the invention is to provide an improved letter opening device employing a retractable safety shield for the cutting blade which is devoid of bias springs and other expensive elements which increase the cost of manufacture.

Another specific object of the invention is to provide an improved letter opening device employing a retractable safety shield which is positively locked in place over the cutting blade during periods of non-use.

Still another specific object of the invention is to provide an improved letter opening device which is similar in size and appearance to a conventional fountain pen and which can be easily and conveniently carried by the user in a shirt pocket or the like.

SUMMARY OF THE INVENTION

The present invention is directed to an improved cutting device and more particularly to a letter opener comprising an elongated tubular handle, a removable tubular cap and a generally L-shaped cutting guide including a cutting blade and a blade holder. The generally L-shaped cutting guide is affixed to the forward end of the tubular handle and has an elongated nose portion which is adapted to fit underneath the flap of an envelope to be opened. The cutting guide includes an elongated groove for receiving the sharp tip of the cutting blade. The blade holder is pivotally mounted to the cutting guide below the tubular handle and holds the blade in place with its cutting edge disposed at an angle with respect to the elongated nose portion of the guide. The blade holder allows the blade to be easily removed and replaced by another blade when the blade holder is pivoted away from the nose portion to release the blade and its tip from the groove.

An elongated safety shield is slidably mounted inside the tubular handle for shielding the blade when the letter opening device is not in use. The safety shield is adapted to move between a first position covering the cutting edge of the blade at its forward end and a second position uncovering the cutting edge for use in cutting the envelope flap.

The shield has an actuating member attached thereto for moving the shield within the tubular handle. The actuating member extends through an elongated slot in the tubular handle and is movable along the slot to locate the shield in either of its first or second positions. The tubular cap also has an elongated slot which can be aligned with the slot in the handle and allow free movement of the actuating member. Conversely, the actuating member can be fixed against movement to lock the shield in place covering the blade when the tubular cap is placed over the handle with its slot in non-coinciding relation with the slot in the tubular handle.

BRIEF DESCRIPTION OF THE DRAWING

The invention will now be described with particular reference to the accompanying drawing wherein.

DESCRIPTION OF THE PREFERRED EMBODIMENTS

Figure 1:
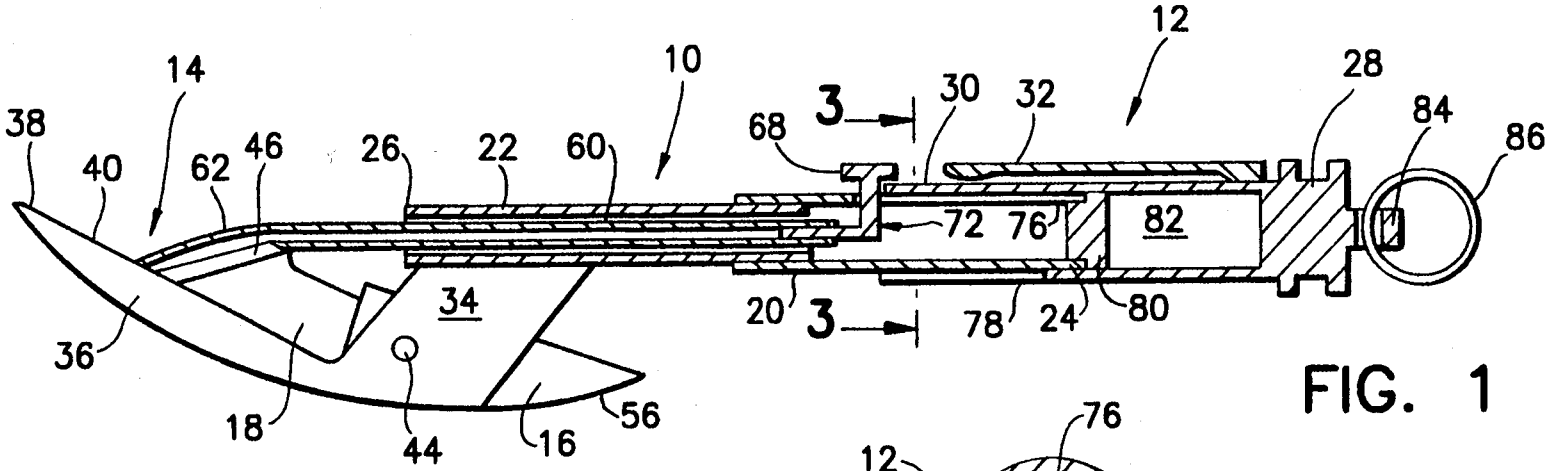
FIG. 1 is a side elevational view, partially in section, of a letter opening device according to the invention.

Referring now to the drawing wherein like reference numerals indicate the same or similar parts, a letter opening device according to the invention includes an elongated tubular handle 10, a removable tubular cap 12 and a cutting guide 14 including a blade holder 16 and a cutting blade 18. The tubular handle 10, tubular cap 12 and the cutting guide 14 may be suitably made of metal or an alloy such as stainless steel, for example, or they may be molded from a plastic material such as polyethylene or polypropylene, for example.

In the embodiment of the invention illustrated, the tubular handle 10 is composed of two separate tubes, namely, a rearward large diameter tube 20 and a forward smaller diameter tube 22. The smaller diameter tube 22 fits tightly inside the larger diameter tube 20 in telescoping fashion forming a tubular handle 10 having a larger diameter rearward end 24 and a smaller diameter forward end 26. The tubes 20, 22 may be permanently joined together such as by gluing or welding, for example. The tubular handle 10 may also be molded in one piece from a suitable plastic material, if desired.

The removable cap 12 has a closed rearward end 28 and an open forward end 30. The open forward end 30 of the cap 12 fits snugly over the rearward end 24 of the handle 10. The handle 10 and cap 12, when assembled together, are similar in size and appearance to a conventional fountain pen or writing instrument and can be conveniently carried in a shirt pocket, for example. For this purpose, the removable cap 12 may be provided with a metal pocket clip 32 as shown in the drawing.

Figure 3:
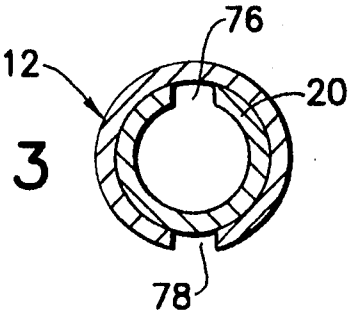
FIG. 3 is a sectional view taken along the line 3—3 in FIG. 1.

The cutting guide 14 is generally L-shaped in configuration and has one of its legs 34 affixed to the tubular handle 10 just below its open forward end 26. The other leg of the cutting guide 14 is long and narrow and forms an elongated nose portion 36. The nose portion 36 is tapered inwardly from the shorter leg 34 of the cutting guide 14 towards an outer point 38 as best shown in FIG. 3. The outer point 38 is adapted to fit and slide underneath the sealed flap of a conventional envelope.

The elongated nose portion 36 of the cutting guide 14 includes a generally straight cutting guide edge 40 which extends rearwardly from the outer point 38. The cutting guide edge 40 is disposed at an acute angle (e.g. about 30 degrees) with respect to the longitudinal axis of the tubular handle 10. This serves to correctly position the blade 18 for cutting the sealed flap and opening the envelope.

Figure 7:
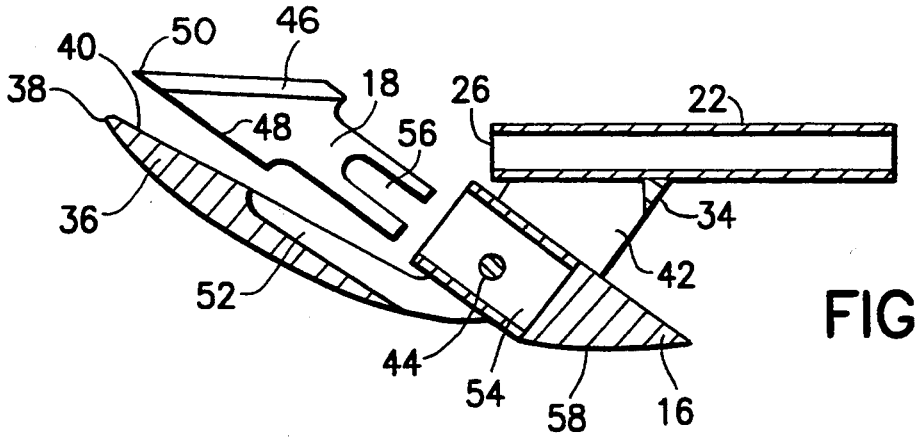
FIG. 7 is a sectional view of the cutting guide employed in the letter opening device illustrated in FIGS. 1 and 4 showing the blade holder pivoted away from the elongated nose portion for removal of the blade.

The blade holder 16 is pivotally mounted within an open notch 42 extending through the shorter leg 34 of the cutting guide 14 as best shown in FIG. 7. The holder 16 pivots about a pin 44 mounted to each side of the leg 34 enabling the holder to move clockwise a short distance for removal and replacement of the blade 18.

As best shown in FIG. 7, the cutting blade 18 is of a conventional design having a sharp cutting edge 46. The cutting edge 46 is disposed at an acute angle with respect to the non-cutting, longitudinal edge 48 of the blade forming a sharp tip 50.

Figure 4:
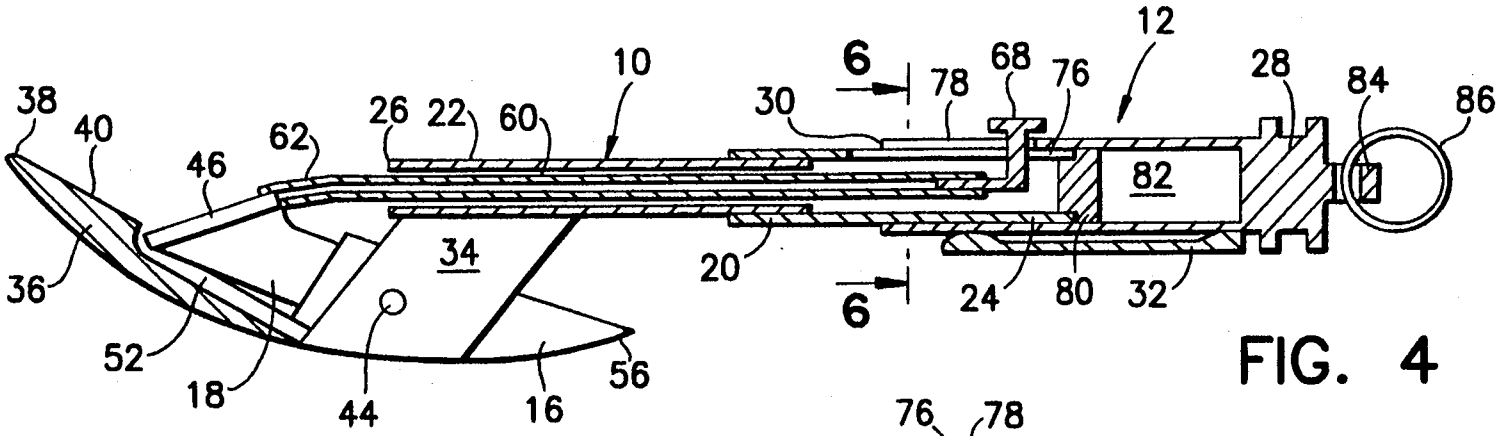
FIG. 4 is a side elevational view, partially in section, of the letter opening device illustrated in FIG. 1 but showing the safety shield withdrawn inside the tubular handle to expose the cutting blade for use in cutting the flap of an envelope.

Since the blade tip 50 is not required for use in severing the envelope flap and could be potentially harmful and unsafe if left exposed, the tip 50 is shielded at all times both during and after use of the cutting device. For this purpose, the cutting guide 14 is provided with an elongated groove 52 along the cutting guide edge 40 for receiving and shielding the blade tip 50 as best shown in FIG. 4. The groove 52 extends rearwardly into the open notch 42 so as to easily accommodate the non-cutting edge 48 of the blade when the blade holder 16 is pivoted counter-clockwise to its normal operative position. The groove 52 thus serves also to firmly secure the blade 18 in place within the cutting device.

The blade holder 16 is formed at its forward end with an elongated rectangular cavity 54 for receiving the cutting blade 18 as shown in FIG. 7. The blade 18 is formed at its rearward end with an elongated slot 56 which fits around the pivot pin 44 when the blade 18 is inserted. This structure also helps to stabilize the blade against movement within the blade holder 16.

At its rearward end, the blade holder 16 extends beyond the notch 42 and is arcuately shaped along its lower edge as at 58 to easily accommodate the user's finger. To remove the blade 18 as described above, it is necessary to grasp the rearward end portion of the blade holder 16 and pivot the holder clockwise to raise the blade above the elongated groove 52 as shown in FIG. 7. Any accidental touching of the lower arcuately shaped edge portion 58 of the holder 16 forces the holder in the counterclockwise direction assuring that the blade 18 remains inside the groove 52.

The arrangement and orientation of the cutting guide 14 and the blade holder 16 are such that the blade 18 is positioned with its cutting edge 46 at a slightly obtuse angle with respect to the cutting guide edge 40 on the nose portion 36. This places the cutting edge 46 at a slightly acute angle to the envelope flap as the outer point 38 and nose portion 36 of the cutting guide 14 pass underneath the flap for best cutting action.

It should also be noted that the above described arrangement places the cutting edge 46 of the blade 18 in a position that is adjacent and substantially coplanar with respect to the longitudinal axis of the tubular handle 10. This more easily accommodates shielding of the cutting edge 46 as shall now be described in detail.

Figure 2:
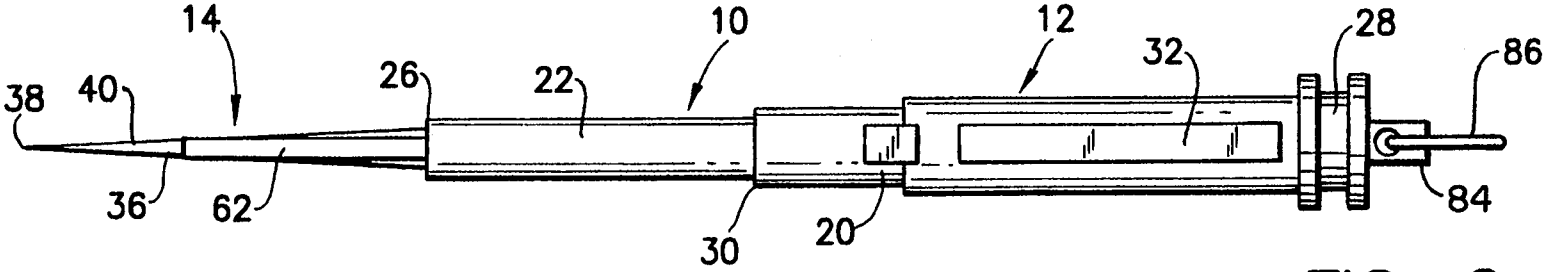
FIG. 2 is a top plan view of the letter opening device shown in FIG. 1.

A retractable, tubular shield 60 is provided in accordance with the invention for covering the cutting blade 18 during periods of non-use. The tubular shield 60 is slightly smaller in diameter than the forward open end 26 of the tubular handle 10 and is slidably mounted inside the handle except for its forward end portion 62. This forward end portion 62 of the shield 60 is curved in a slightly downward direction and overlies the cutting blade 18 as shown FIGS. 1 and 2. The shield 60 may be made from a rigid metal tube or a tube made of a flexible plastic material.

Figure 8:
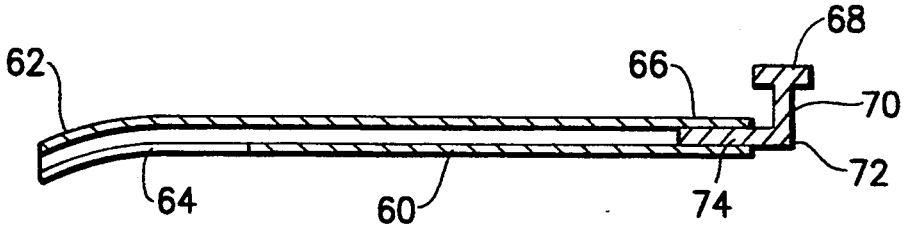
FIG. 8 is a side elevational view in section of the safety shield employed in the letter opening device of the invention.
Figure 9:
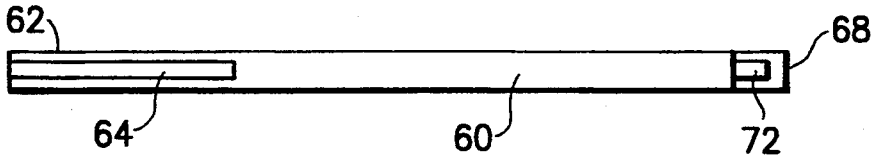
FIG. 9 is a bottom view of the safety shield shown in FIG. 8.

FIGS. 8 and 9 show the tubular shield 60 in detail wherein it will be noted that the curved forward end 62 of the tube is provided on its underneath side with a slot 64 for receiving the entire cutting edge 46 of the blade 18. The opposite rearward end portion 66 of the tubular shield 60 is provided with a rectangular knob 68 for slidably moving the tube inside the tubular handle 10. As shown in FIG. 8, the knob 68 is attached to one leg 70 of a generally L-shaped stem portion 72. The other leg 74 of the stem portion 72 is pressed fitted into the rearward end 66 of the shield 60.

As shown in FIGS. 1, 3, 4 and 5, the tubular handle 10 is formed with an elongated slot 76 extending forwardly from its rearward open end 24 to an intermediate point on the handle 10. Similarly, the tubular cap 12 is formed with an elongated slot 78 extending rearwardly from its forward open end 30 to an intermediate point on the cap 12.

The leg 70 of the stem portion 72 is slidably mounted within the elongated slot 76 provided in the tubular handle 10. In the position of the tubular shield 60 shown in FIG. 1 wherein the shield overlies completely the cutting edge 46 of the blade 18, the knob 68 is located at the forward end of the slot 76. The tubular cap 12 is orientated in the views of FIGS. 1 and 2 with its elongated slot 78 in a non-aligned position with respect to the slot 76 in the handle 10 as best shown in FIG. 3. With this orientation of the cap 12, it will be seen that the knob 68 is locked in position at the forward end of the slot 76 by the forward end 30 of the cap 12. This effectively secures the tubular shield 60 in its position overlying and covering the blade 18.

Figure 6:
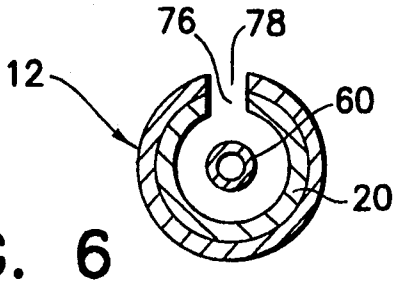
FIG. 6 is a sectional view taken along the line 6—6 in FIG. 5.
Figure 5:
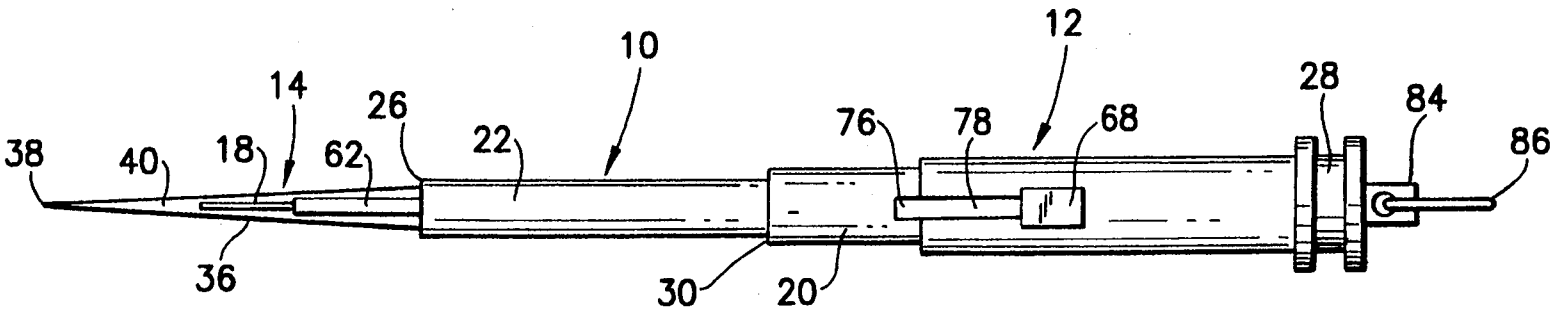
FIG. 5 is a top plan view of the letter opening device shown in FIG. 4.

However, when it is desired to .use the letter opening device, the tubular cap 12 can be removed and replaced on the tubular handle 10 with its slot 78 aligned with the slot 76 in the tubular handle 10 as shown in FIGS. 4, 5 and 6. With this orientation of the cap 12, the knob 68 is unlocked and free to move longitudinally along the both slots 76 and 78. It should be noted that when the knob 68 reaches the rearward end of the slot 78 in the cap 12, the tubular shield 60 is almost completely retracted from its position overlying the blade 18, exposing the cutting edge 46 of the blade for cutting through the envelope flap. Preferably, however, a part of the shield 60 remains in contact with the blade 18 to further secure the blade in place within the groove 52 as shown in FIG. 4.

It is possible, of course, to operate the letter opening device without the tubular cap 12 positioned in place on the rearward end of the handle 10. For this purpose and to restrict movement of the knob 68 at the end of the slot 76, a cylindrical plug 80 is permanently secured inside the rearward end 24 of the handle 10. This plug also separates the handle 10 from the interior of the cap 12 and provides a compartment 82 for storing extra blades and the like.

The tubular cap 12 may also be formed with an apertured stem 84 at its rearward end for securing a metal ring 86 thereto. The ring 86 is convenient for carrying the letter opener or hanging the device at some convenient location.

What is claimed is:

1. A letter opening device comprising, in combination:

an elongated tubular handle having an open forward end and an open rearward end, said handle having an elongated slot extending forwardly from said rearward end to an intermediate portion of said handle;

an elongated tubular cap having an open forward end and a rearward end, said tubular cap having an elongated slot extending rearwardly from said forward end to an intermediate portion of said cap, said cap being removably fitted snugly over said rearward end of said tubular handle;

a generally L-shaped cutting guide affixed at one end to the forward end of said tubular handle and forming at its opposite end an elongated nose portion adapted to fit underneath the flap of an envelope to be opened, said elongated nose portion having a cutting guide edge disposed ahead of said forward end of tubular handle at an angle with respect to the longitudinal axis of said tubular handle, said cutting guide edge having an elongated groove therein;

a blade holder pivotally mounted to said cutting guide below said forward end of said tubular handle and having a cutting blade removably mounted therein, said blade having a cutting edge and a non-cutting edge joined at a tip portion, the arrangement of said cutting guide and blade holder being such that said blade is positioned with said cutting edge disposed at an angle with respect to said cutting guide edge and with said tip portion secured inside said groove during use, said blade holder at the same time being pivotable allowing said blade to be removed and replaced by another blade when said blade holder is pivoted away from said groove to expose said tip portion;

an elongated safety shield slidably mounted inside said tubular handle and moveable between a first and second position, said safety shield having a forward end adapted to cover said cutting edge of said blade in said first position and to uncover said cutting edge when said shield is moved to said second position; and an actuating member attached to said safety shield for moving said shield between said first and second positions, said actuating member extending through said slot in said tubular handle and being slidably movable therein when said slot in said tubular cap is aligned therewith but being fixed against movement when said slots are not aligned, thereby locking said shield in said first position covering said cutting edge of said blade.

2. A letter opening device according to claim 1 wherein said elongated tubular handle is composed of a rearward larger diameter tube and a forward smaller diameter tube joined together in telescoping relation.

3. A letter opening device according to claim 1 wherein a notch is formed within one leg of said generally L-shaped cutting guide, said one leg being affixed to said tubular handle and wherein said blade holder is pivotally mounted within said notch by a pivot pin fixed to the sides of said leg.

4. A letter opening device according to claim 3 wherein said blade holder has a cavity formed in one end closest to said groove for receiving said blade.

5. A letter opening device according to claim 4 wherein an opposite end of said blade holder is arcuately shaped and extends rearwardly from said notch.

6. A letter opening device according to claim 1 wherein said elongated safety shield is tubular and has a curved outer end at said forward end which covers said cutting blade.

7. A letter opening device according to claim 6 wherein said curved outer end of said tubular safety shield has a slot for receiving the cutting edge of said blade.

8. A letter opening device according to claim 7 wherein said actuating member comprises a knob attached to an L-shaped stem having one leg press-fitted into a rearward open end of said tubular safety shield.

9. A letter opening device according to claim 1 wherein said tubular cap has a clip attached thereto for securing said device within a user's pocket.

10. A letter opening device according to claim 1 wherein said tubular cap has a ring attached thereto for carrying said device.

11. A letter opening device according to claim 1 wherein the arrangement of said cutting guide and said blade holder is such that the cutting edge of said blade is adjacent and substantially coplanar with the longitudinal axis of said tubular handle.

12. A letter opening device according to claim 1 wherein the open rearward end of said tubular handle is closed by a plug restricting movement of said actuating member in said slot formed in said handle.

13. A letter opening device according to claim 12 wherein said plug in conjunction with said tubular cap provides a storage compartment inside said device.

14. A letter opening device comprising, in combination:

an elongated tubular handle having an open forward end and an open rearward end, said handle having an elongated slot extending forwardly from said rearward end to an intermediate portion of said handle;

an elongated tubular cap having an open forward end and a rearward end, said tubular cap having an elongated slot extending rearwardly from said forward end to an intermediate portion of said cap, said cap being removably fitted snugly over said rearward end of said tubular handle;

a generally L-shaped cutting guide formed by two legs wherein one leg is affixed to the forward end of said tubular handle, said one leg having an open notch extending therethrough, the other leg of said cutting guide forming an elongated nose portion adapted to fit underneath the flap of an envelope to be opened, said elongated nose portion having a cutting guide edge disposed ahead of said forward end of tubular handle at an angle with respect to the longitudinal axis of said tubular handle, said cutting guide edge having an elongated groove therein;

a blade holder pivotally mounted to said cutting guide within said notch below said forward end of said tubular handle and having a cutting blade removably mounted therein, said blade having a cutting edge and a non-cutting edge joined at a tip portion, the arrangement of said cutting guide and blade holder being such that said blade is positioned with said cutting edge disposed at an angle with respect to said cutting guide edge and with said tip portion secured inside said groove during use, said blade holder at the same time being pivotable allowing said blade to be removed and replaced by another blade when said blade holder is pivoted away from said groove to expose said tip portion;

an elongated tubular safety shield slidably mounted inside said tubular handle and moveable between a first and second position, said tubular safety shield having a slot in its forward end adapted to receive said cutting edge of said blade in said first position, said shield being withdrawn from said blade to uncover said cutting edge when said shield is moved to said second position, and a knob having an L-shaped stem one leg of which is fitted inside a rearward open end of said tubular safety shield for moving said shield between said first and second positions, the other leg of said stem extending through said slot in said tubular handle and being slidably movable therein when said slot in said tubular cap is aligned therewith but being fixed against movement when said slots are not aligned, thereby locking said shield in said first position covering said cutting edge of said blade.

* * * * *